US010718500B1

(12) United States Patent
Tylicki et al.

(10) Patent No.: US 10,718,500 B1
(45) Date of Patent: Jul. 21, 2020

(54) SOLAR POWERED SECURITY LIGHT WITH VARIABLE MOUNTING

(71) Applicant: HeathCo LLC, Bowling Green, KY (US)

(72) Inventors: Scott Blaise Tylicki, Bowling Green, KY (US); Leeman Elliot Stevens, Bowling Green, KY (US)

(73) Assignee: HEALTHCO LLC, Bowling Green, KY (US)

( * ) Notice: Subject to any disclaimer, the term of this patent is extended or adjusted under 35 U.S.C. 154(b) by 0 days.

(21) Appl. No.: 16/557,492

(22) Filed: Aug. 30, 2019

(51) Int. Cl.

| | |
|---|---|
| ***F21V 21/30*** | (2006.01) |
| ***F21V 23/04*** | (2006.01) |
| ***F21V 21/088*** | (2006.01) |
| ***F21S 9/03*** | (2006.01) |
| ***F21Y 115/10*** | (2016.01) |

(52) U.S. Cl.
CPC ..... *F21V 21/30* (2013.01); *F21S 9/032* (2013.01); *F21V 21/088* (2013.01); *F21V 23/0471* (2013.01); *F21Y 2115/10* (2016.08)

(58) Field of Classification Search
CPC ... F21S 9/032; F21S 9/03; F21S 9/035; F21V 21/30; F21V 23/0471
See application file for complete search history.

(56) References Cited

U.S. PATENT DOCUMENTS

| | | | | |
|---|---|---|---|---|
| 1,811,594 | A | 10/1932 | Hotchkin | |
| 3,193,229 | A | 7/1965 | Stock | |
| 3,531,636 | A | 9/1970 | Birch | |
| 3,762,082 | A | 10/1973 | Mincy | |
| 4,667,142 | A | 5/1987 | Butler | |
| 4,823,241 | A | 4/1989 | Trattner | |
| 4,890,093 | A | 12/1989 | Allison et al. | |
| 5,055,984 | A | 10/1991 | Hung et al. | |
| 5,149,188 | A | 9/1992 | Robbins | |
| 5,217,296 | A * | 6/1993 | Tanner | F21V 21/30 362/183 |
| 5,410,458 | A | 4/1995 | Bell | |
| 5,813,749 | A | 9/1998 | Sheldon | |

(Continued)

FOREIGN PATENT DOCUMENTS

| | | | |
|---|---|---|---|
| BR | 9805481 | A | 8/2000 |
| CH | 611446 | A5 | 5/1979 |

(Continued)

OTHER PUBLICATIONS

US 5,384,858 A, 02/1995, Bender et al. (withdrawn)

(Continued)

*Primary Examiner* — William N Harris
(74) *Attorney, Agent, or Firm* — Middleton Reutlinger

(57) ABSTRACT

A solar powered security light is provided which includes a universal mounting bracket. The security light has a mounting recess which receives the mounting bracket and allows the luminaire to be variably installed in an eave, wall, and gutter or pole mount position. The solar charging station includes associated charging circuits to charge storage devices such that the security light does not need directly line voltage connection. Further the charging station may be placed remote from the luminaire housing and include required electronics thereby reducing the footprint of the luminaire housing and increasing the installation locations.

21 Claims, 15 Drawing Sheets

(56) References Cited

U.S. PATENT DOCUMENTS

| | | | | |
|---|---|---|---|---|
| 6,060,658 | A | 5/2000 | Yoshida et al. | |
| 6,152,582 | A | 11/2000 | Klaus | |
| 6,280,053 | B1 | 8/2001 | Chien | |
| 6,517,217 | B1 | 2/2003 | Liao | |
| 6,522,263 | B2 | 2/2003 | Jones | |
| 6,686,701 | B1 | 2/2004 | Fullarton | |
| D494,536 | S | 8/2004 | Pu | |
| 6,830,058 | B2 | 12/2004 | Li | |
| 6,840,657 | B2 | 1/2005 | Tung | |
| 6,851,823 | B2 | 2/2005 | Bilotti | |
| 6,948,826 | B2 | 9/2005 | Fogerlie | |
| 6,964,498 | B2 | 11/2005 | Wu | |
| 7,819,545 | B2 | 10/2010 | Ponamar | |
| 7,891,832 | B2 | 2/2011 | Allsop et al. | |
| 8,029,154 | B2 | 10/2011 | Myer | |
| 8,141,306 | B2 | 3/2012 | Masuda et al. | |
| 8,371,730 | B2 * | 2/2013 | Mitchell | B60Q 1/0483 362/477 |
| 8,384,556 | B2 | 2/2013 | Ko et al. | |
| 8,621,245 | B2 | 12/2013 | Shearer et al. | |
| 8,696,152 | B2 | 4/2014 | Cumberland | |
| 8,714,768 | B2 | 5/2014 | Tittle | |
| 8,810,191 | B2 | 8/2014 | Maldonado | |
| 8,884,531 | B1 | 11/2014 | Xu | |
| 9,046,235 | B2 | 6/2015 | Wilson | |
| 9,078,313 | B2 | 7/2015 | Recker et al. | |
| 9,197,033 | B1 * | 11/2015 | Tsai | H01S 5/4025 |
| 9,677,728 | B2 * | 6/2017 | Toner | E04H 12/32 |
| 9,839,088 | B1 | 12/2017 | Deaton | |
| 9,970,611 | B2 * | 5/2018 | Toner | F21S 9/032 |
| 10,168,032 | B2 * | 1/2019 | Bailey | F21V 21/02 |
| 2003/0098976 | A1 | 5/2003 | Yamauchi | |
| 2004/0228123 | A1 * | 11/2004 | Stewart | F21S 9/032 362/183 |
| 2005/0083681 | A1 | 4/2005 | Yeh | |
| 2005/0103378 | A1 * | 5/2005 | Pu | F21S 9/032 136/244 |
| 2005/0146874 | A1 | 7/2005 | Cech et al. | |
| 2005/0248934 | A1 | 11/2005 | Weiser et al. | |
| 2006/0012978 | A1 | 1/2006 | Allsop et al. | |
| 2006/0139912 | A1 | 6/2006 | Norton et al. | |
| 2006/0227542 | A1 | 10/2006 | Richmond | |
| 2007/0002561 | A1 * | 1/2007 | Tesmer | F21S 9/035 362/183 |
| 2007/0084500 | A1 * | 4/2007 | Chen | H02S 20/30 136/244 |
| 2007/0159836 | A1 | 7/2007 | Huang et al. | |
| 2011/0304273 | A1 | 12/2011 | Bennette | |
| 2012/0206276 | A1 * | 8/2012 | Cai | G08G 1/095 340/907 |
| 2019/0211985 | A1 * | 7/2019 | Wijaya | F21S 9/032 |

FOREIGN PATENT DOCUMENTS

| | | | |
|---|---|---|---|
| CN | 205655221 | U | 10/2016 |
| DE | 3635209 | A1 | 4/1988 |
| EP | 386811 | A1 | 9/1990 |
| EP | 1291834 | A1 | 3/2003 |
| EP | 1500870 | A1 | 1/2005 |
| JP | 11318218 | A | 11/1999 |
| JP | 2001230433 | A | 8/2001 |
| KR | 200470305 | Y1 | 1/2014 |
| KR | 101369783 | B1 | 3/2014 |

OTHER PUBLICATIONS

Silicon Solar, Solar-powered LED security spotlight—Model No. 44311, 2010, China.

Ballar et al., Sun-Tracking Solar-Powered LED Street Light, California Polytechnic State University, Jun. 2015, US.

* cited by examiner

SOLAR POWERED SECURITY LIGHT WITH VARIABLE MOUNTING

BACKGROUND

Outdoor security lighting is frequently utilized around homes and typically includes a standard luminaire mounted on a wall surfaces directly at a junction box. However, depending on the structure, the mounting parameters for securing the light on the structure may vary significantly when the security light is solar powered. The variety of mounting surfaces limits the ability of many outdoor security lights to be mounted appropriately, especially with added luminaire housing elements such as solar panels and control units which may be separated from the primary security luminaire housing. Further, solar powered security lights may be positioned in far flung locations given the freedom of not having voltage located directly at the luminaire site. Therefore, providing appropriate mounting structure on a luminaire for the variety of potential independent mounting surfaces can prove difficult.

SUMMARY

In some embodiments, a variably mountable solar powered security light is provided which includes the ability to mount the security light in multiple positions and locations. The security light may include a universal mounting bracket which is removably attachable to the security luminaire housing and which includes the ability to mount the security light on multiple structures. For example, the security light may be mounted on a wall, under an eve, or to a pole or other vertically extending substantially cylindrical or other shaped object. Other mounting surfaces may additionally or alternatively be supported such as, for example, a gutter mount where the luminaire may be mounted to the lip or other edge surface of a gutter. The security light may also include a separated remote charging station which includes photovoltaic cells and rechargeable battery power system providing electrical power to the security light thereby removing the necessity of having a line voltage source from any structure nearby. In some of these implementations, the remote charging station may include a charging circuit and/or related electronics to allow recharging of rechargeable batteries located in the charging station. The charging station may be electrically connected to the luminaire housing to power the LEDs or other light sources which are located on the security light as well as other required electronics. In some implementations, the LED controller and other related electronic circuitry necessary for driving and controlling the light sources may be placed at the remote charging station thereby reducing the size of the luminaire housing.

Various implementations of the mounting system for the variably mountable security light may include a mounting surface, such as for example a recess, formed on luminaire housing which receives a mounting bracket. The mounting bracket would therefor allow for variability in positioning of the mounting system, including allowing the mounting bracket to be used for any of the recited mounting structures, including the eave mount, pole mount and wall mount. Additionally the mounting bracket may be further adjustable to allow mounting on a gutter edge by inclusion of a removably attachable gutter clip which may be received within the mounting bracket.

These and other features may be achieved by utilizing the variably mountable security light described herein.

In embodiments disclosed herein, an outdoor variably mountable security light is disclosed. The variably mountable security light may have remote solar charging panels and include a multiple support mounting bracket, the security luminaire including a motion security light having a lamp head with an LED emitting surface, the lamp head hingedly connected to a luminaire housing, the luminaire housing alternatively having a motion sensor. The lamp head may have a plurality of LEDs behind an LED emitting surface on the lamp head, the plurality of LEDs in electrical communication with an LED controller. The luminaire housing may further have a housing mount, the housing mount including a mounting recess and a first and a second retention flange respectively on opposing sides of the mounting recess. The security light may further have a solar charging base with a photo-voltaic cell panel hingedly connected to the charging base, the charging base including an interior electrical cabinet containing at least one rechargeable battery, the solar charging base and the at least one rechargeable battery in electrical connectivity with plurality of LEDs in the luminaire housing. In some implementations, the solar charging base may be optionally remotely positioned from the luminaire housing and electrically connected to the at least one rechargeable battery through an electrical connector line. The security light may further include a universal mounting bracket removably retained within the mounting recess of the luminaire housing, the universal bracket having a sliding flange extending around at least a portion of a periphery of the universal bracket. In variations, the universal bracket may include a first and a second mounting aperture, a first and a second strap aperture and gutter clip removably attachable to the universal bracket.

Such a security light may optionally include one or more of the following features.

In implementations, the security light includes a luminaire housing which is fixedly connected to the housing mount. In other implementations, the housing mount is integral with the luminaire housing. In still further implementations, the gutter clip may have a depending flange opposing to first and a second depending gutter clip locking tongues. Still further implementations may include the universal bracket sliding flange which extends around an upper edge and partially around a first and second opposing side edges. In still further embodiments, the universal bracket may have a recessed area defined by a bracket peripheral wall. Optionally, such may further include the bracket peripheral wall having a first and a second bracket retention tab depending from the peripheral wall into the recessed area. Alternatively, the first and the second strap aperture may be formed in opposing relationship on the universal bracket peripheral wall. Even further options may include the bracket peripheral wall being inset on the universal bracket forming the sliding flange.

In some embodiments, the gutter clip may include a cross member extending across the first and second depending locking tongues of the gutter clip and may also include an inwardly directed projection formed on at least one of the first or second gutter clip locking tongue which fits into an associated locking recess formed on the universal bracket. In addition, in various implementations, each of the first and the second gutter clip locking tongues may have an inwardly directed projection mating into an associated locking recess formed in the universal bracket.

In further implementations, the security light may include the solar charging base electrical cabinet having or including a charging circuit in connectivity with the photo-voltaic cell panel and with the at least one rechargeable battery or energy storage unit, both of which are operable to store power for later dissipation to the load of the circuits and light fixture. Such may further optionally include the solar charging base having or including the LED controller within the electrical cabinet, the LED controller in electrical connectivity with the plurality of LEDs and modulating the LEDs with electrical power from the at least one rechargeable battery.

In still further optional implementations, the solar charging base has a plurality of anchors to secure the solar charging base to a structure.

In other implementations, the security light may include a variably mountable security light with remote solar charging panels and multiple support mounting bracket, comprising a lamp head hinged to luminaire housing, the lamp head including a plurality of LEDs in thermal contact with a heat sink, the plurality of LEDs in electrical communication with an LED controller; the luminaire housing having a luminaire housing mount, the housing mount having a housing mounting recess and opposing first and second retention flanges on a first and second side of the housing mounting recess, the housing mounting recess and first and second retention flanges slidably receiving a mounting bracket. Further aspects include the mounting bracket having a sliding flange extending along at least a portion of the peripheral edge of the bracket, the sliding flange formed by an inset bracket peripheral wall, the bracket peripheral wall inset on at least a portion of an outer edge of the periphery of the bracket, the inset bracket peripheral wall forming the sliding flange. Still further features incorporate the mounting bracket having a first and a second mounting aperture forming a recess area surrounded by the bracket peripheral wall wherein the bracket peripheral wall having opposed first and second strap apertures. Other aspects include the bracket having at least one bracket retention tab operable to slidably receive a gutter clip, the gutter clip having a depending flange opposing the at least one bracket retention tab creating a space there between, the at least one bracket retention tab also having a locking recess which receives a projection tab on the gutter clip to lock the gutter clip into place on the mounting bracket. Still further aspects include a solar charging station having a photo-voltaic cell hinged to a charging station base, the charging station base including a charging circuit and the LED controller, the charging station electrically connected to the luminaire housing by an electrical connecting line and operable to power the plurality of LEDs and control the plurality of LEDs in the lamp head.

Such a security light may optionally include one or more of the following features.

The variably mountable security light may include the mounting bracket having a first and a second bracket retention tab to slidably receive the gutter clip, each of the first and the second bracket retention tab having a locking recess to receive a projection extending from respective first and second gutter clip locking tongues on the gutter clip.

Other implementations may optionally or additionally include the gutter clip depending flange opposing the first and second locking tongues and is angled away from the locking tongues.

Still further variations may optionally incorporate the mounting bracket having a depending locking tab having a channel, the depending locking tab channel of the mounting bracket receiving a projection extending outward from the housing mounting recess to lock the mounting bracket in place after being slidably received in the mounting recess.

Additional implementations may optionally include the sliding flange having a first sliding flange surface and a second sliding flange surface, the first and second retention flanges of the housing mount respectively sliding over the first and the second sliding flange surfaces of the mounting bracket.

As used herein for purposes of the present disclosure, the term "LED" should be understood to include any electroluminescent diode or other type of carrier injection/junction-based system that is capable of generating radiation in response to an electric signal and/or acting as a photodiode. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" or "illumination source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. A given unit may have any one of a variety of mounting arrangements for the light source(s), enclosure/housing arrangements and shapes, and/or electrical and mechanical connection configurations. Additionally, a given unit optionally may be associated with (e.g., include, be coupled to and/or packaged together with) various other components (e.g., control circuitry) relating to the operation of the light source(s). An "LED-based fixture" refers to a lighting unit that includes one or more LED-based light sources as discussed above, alone or in combination with other non LED-based light sources. A "multi-channel" lighting unit refers to an LED-based and/or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), field-programmable gate arrays (FPGAs), and discrete logic.

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
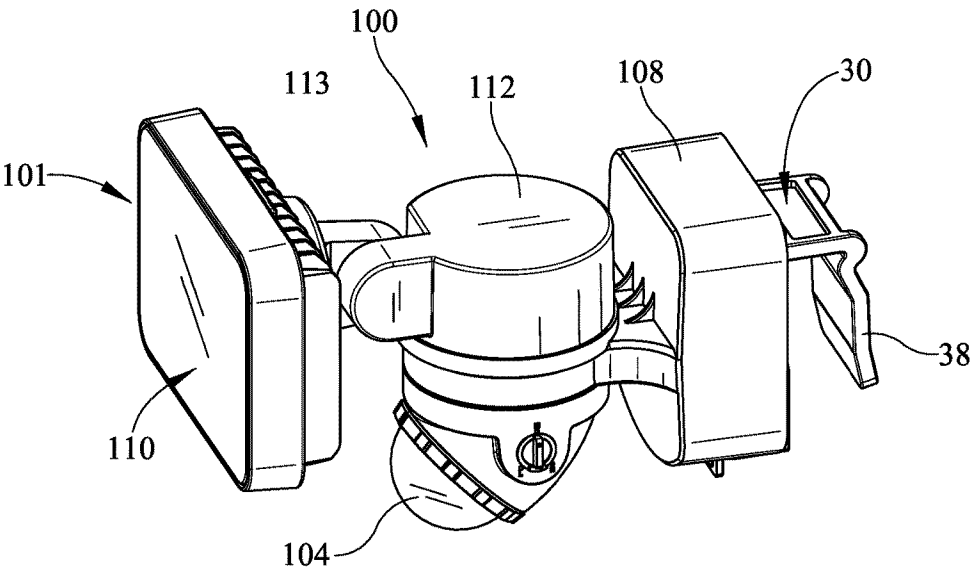
FIGS. 1 and 2 are perspective views of an implementation of the security light described herein.

It is to be understood that a security light is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 2:
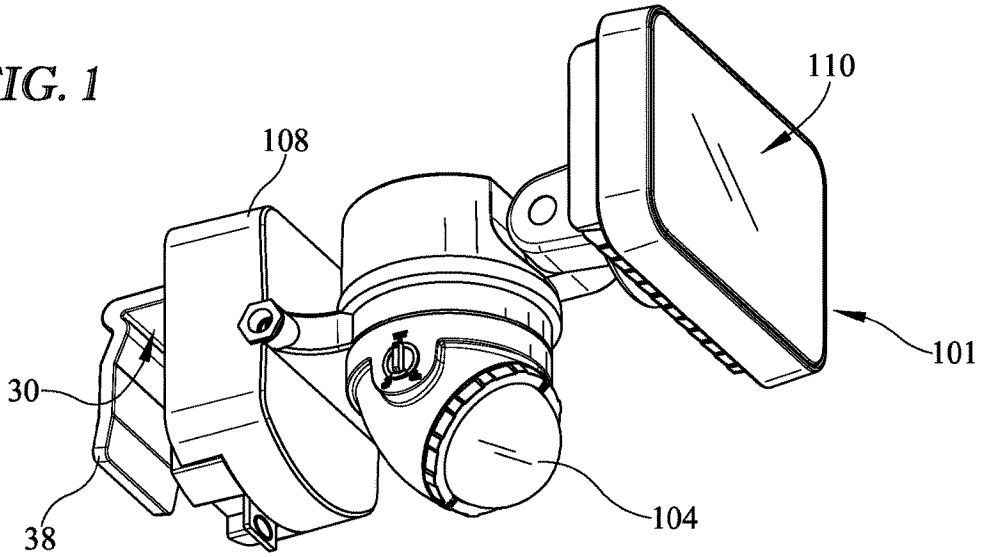
Figure 3:
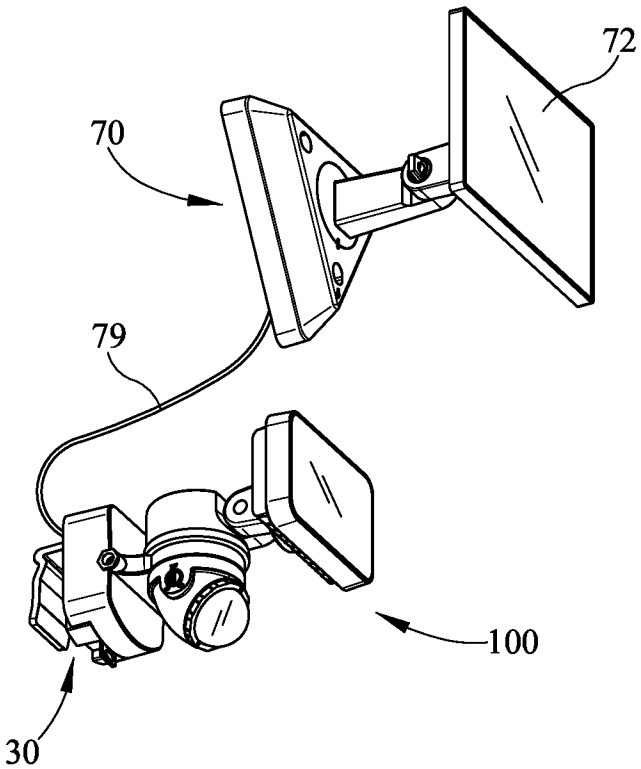
FIG. 3 illustrates a perspective of the security light described herein.
Figure 4:
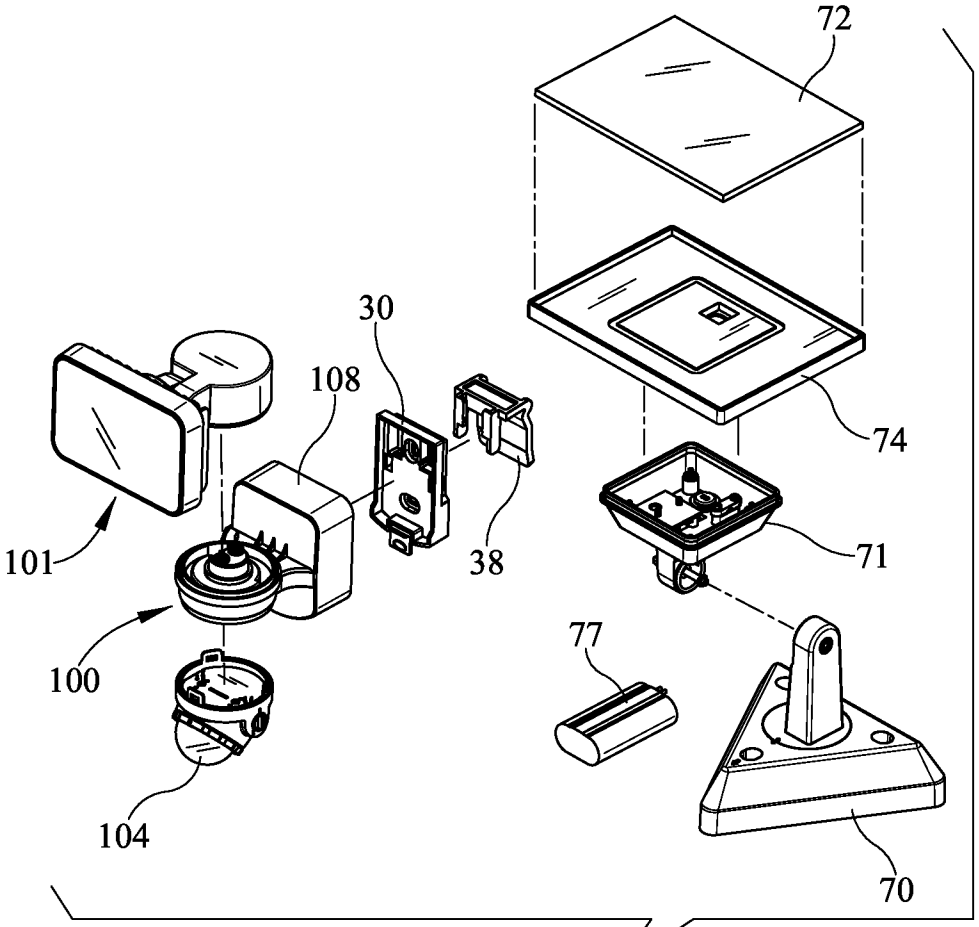
FIG. 4 illustrates an exploded view of the security light depicted in FIG. 3.

As shown in FIGS. 1 and 2, the security light 100 portion set forth herein may include various components including the lamp head 101 which incorporates light sources, in this example, a plurality of LEDs 86 which emit light through an LED output surface 110. The lamp head 101 may be adjustably connected to a luminaire housing 112 which includes or incorporates a luminaire housing mounting surface 108. The housing mount surface 108 may be fixedly or adjustably connected to the luminaire housing 112, may be an integrated structure with the luminaire housing or may be an extension of the luminaire housing. For mounting purposes, the security light housing mount 108 may be positioned on the rear surface which may interface with the universal mounting bracket 30. The housing mount may include a separated structural device onto which the mounting bracket attaches, may be integrated directly with the luminaire housing 112 or may be removable or replaceable structure which removeably affixes to the various structures.

The housing mount 108 may provide a surface structure which allows for the attachment of the security light luminaire 100 to a canopy or other surface or structure. Housing mount 108 may be releasably connected to a universal bracket 30, depicted in FIG. 5, for attaching the security light 100 to a canopy type structure or other surface for remote positioning of the security light in combination with the solar charging station 70. Additionally, and as is optionally depicted in FIGS. 1 and 2, a gutter clip may be affixed to the universal bracket on the rear surface of the housing mount 108 in order to affix the security light to a gutter while attaching the solar charging station remotely therefrom. Such installation, due to the remote charging station and the adaptability of the housing mount and bracket 30 provides for multiple installation positions around a house or other outdoor location without the need for direct electrical connection as is typically required for outdoor security illumination.

Figure 12:
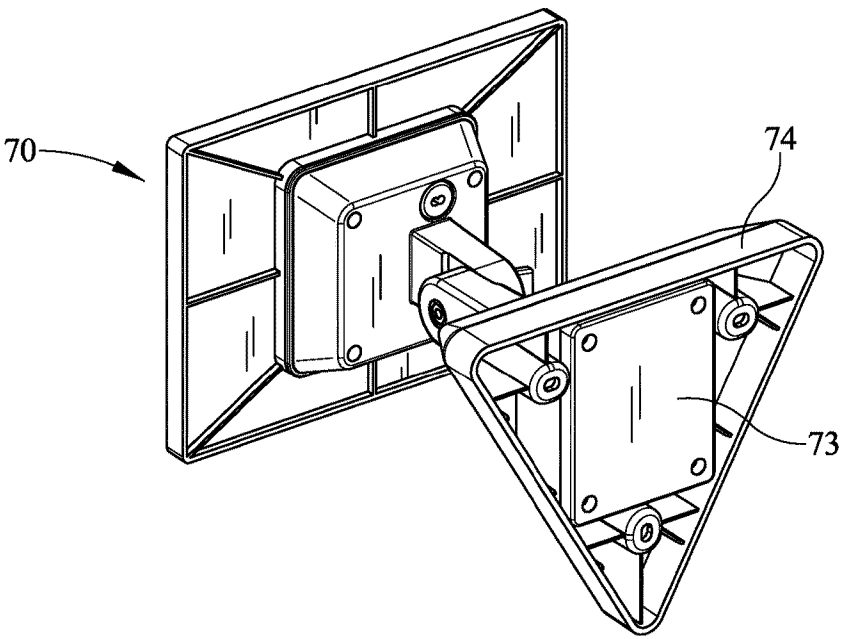
FIGS. 11 and 12 detail perspective views for the solar charging station described herein.
Figure 11:
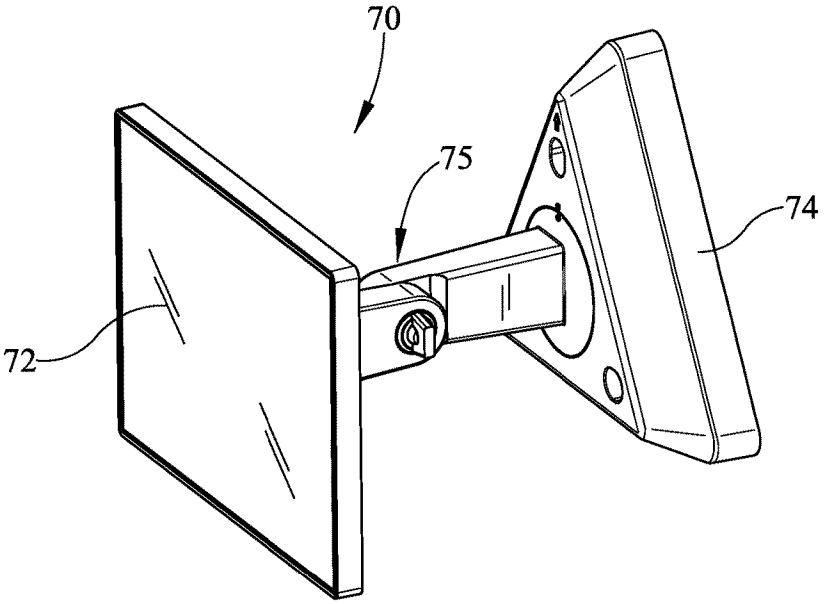

Lamp head 101 may include various known light sources, such as LEDs, OLEDs, fluorescent and incandescent. Of course, when combined with a remote charging station and rechargeable battery supply, power draw may be an issue and conservative utilization of available power source may be taken into consideration. Such discussion within this description however utilizes all such light sources interchangeably. When combined with at least one or a plurality of LEDs, the security light 100 becomes an LED based fixture or luminaire where the light sources, in some examples as described including LEDs, are controlled by an LED controller, driver and/or other circuits or electronics. As depicted in FIGS. 1 and 2 the security light 100 may further include or incorporate a hinged lamp head 101 such that the light output may be variously directed. Such lamp head may optionally combine a lens to define the light output surface 110 which may overlay the high or low density positioning of the LEDs. Of course, in some implementations, the LEDs may individually include lens covers which seal the die and light emitting electronic portion and which may also direct light individually and independently. Further, to create further independence on the location installation of the security light described herein, the light sources and the various electronics may be powered by a remote solar charging station 70 as is depicted in FIGS. 11 and 12.

Returning to FIGS. 1-4, various components may be combined for the security light 100 described herein including the universal mounting bracket 30, solar charging station 70 which may include photo-voltaic cells (PVC) 72 and an electrical connecting line 79. Additionally, the security light may optionally include a motion sensor 104 connected to the luminaire housing 112. Electronics may be variously incorporated into the security light, either on board or remotely which determines the existence of motion signals from the motion sensor and which modifies the output characteristics of the LEDs or other illumination sources. Such output characteristics may include intensity, color, flashing, or may combine such motion detection indication with other sensors such as ambient light to adequately modify and define light output characteristics.

In some implementations a remote solar charging station 70 may be provided which can be mounted in a location which is more conducive to collection of sunlight on the PVC. The solar charging station 70 may include at least one rechargeable battery 77 which fits within the base 74, the base optionally including a charging circuit 71 and illumination controllers, such as an LED controller. Such solar charging station, while disclosed as being remote from the security light housing 100, may be affixed thereto in various other installations.

Variously known charging circuits may be integrated with the batteries and the solar charging station. Such charging circuits may include known techniques for receiving the generated low voltage from the PVC which may be anywhere between single volt up to a standard 12 volts, depending on the number of cells respectively connected together. Typically individual cells produce an open circuit voltage of about 0.5 to 0.6 volts at 25 C. This voltage and the associated current is managed by a charging circuit for trickle charging of the rechargeable battery circuit and also protecting the batteries from overcharging, monitoring battery charge levels and reporting such levels to a controller and also limiting input and output current to the various parts of the system. Alternatively, the charging circuit may also integrate a separate backup battery system which may be utilized wherein combinations of batteries are used. For example, standard power to be provided to the LEDs may derive from the rechargeable batteries while a backup battery system may also be provided which integrates standard non-rechargeable batteries to provide electricity to the illumination sources when the rechargeable batteries are determined to be too low. Further, other power usage functionality may be implemented such as reducing the modulation frequency of the LEDs once certain voltage levels are reached, modifying the light output or other characteristics, reading ambient temperature characteristics to modify charging cycles and the like.

Multiple components of the luminaire may be optionally included into the security light housing, such as a motion sensor 104. The motion sensor may be affixed directly to the luminaire housing 112 or may be remote therefrom and may be connected to the luminaire electronics either by a wired or a wireless connection. For example, a motion sensor may communicate with the luminaire controller from a remote location and provide a signal indicating detected motion. In some examples, the motion sensor may be PIR, but many known motion detection techniques and hardware may be implemented. For example, radar, image detection or other light detection or analytic systems may be implemented for the detection of a person or other object within a field of view. As depicted, the motion sensor 104 may include a cover or other lens to focalize incoming radiation as needed.

Still further implementations may include any number of lamp heads which may be adjustably connected to the luminaire housing. For example, a single lamp head 101 may be connected via a multi-axis hinge to adjust the light output or throw as needed after installation. Alternatively, multiple lamp heads may be connected to the luminaire housing. Even further implementations may allow for separated lamp heads remote from the luminaire housing 112 and connected thereto by an electrical connection to power and control the illumination sources.

In some implementations, a plurality of LEDs may be included within the lamp head 101 which are controlled or driven by an LED controller 85 as shown in FIG. 12. The LED controller may be provided to drive the LEDs, modify their output and/or color and also modulate the LEDs for particular light output characteristics. Various LED drivers and controllers are known for implementation and control of light from the LEDs. For example, an LED controller may include an integrated driver circuit connected to the power source which drives the LEDs utilizing modulation techniques. For example, the LEDs may be modulated using pulse width modulation. Other known techniques may be utilized. For example, frequency modulation may also be used to drive the LEDs when implementing an LED based luminaire. Other light sources, as previously stated, may also be used and powered/controlled by a controller.

In addition, the LED controller may combine other features and functionality of the luminaire. For example, various inputs may be fed into the controller to determine illumination characteristics such as motion detect signals, ambient light level signals, temperature signals or user selected settings. The controller may modify the output based upon such sensor input or settings and effect control of the light output based upon defined conditions. The controller may utilize program instructions stored in memory associated with a processor, fixed circuits designed to implement such features or any combination of other known techniques. For example, circuits may be used to read ambient lighting levels to determine when the sun has set and allow for reduced illumination levels until full darkness has been reached. Alternatively or in additional thereto microprocessors may implement all or portions of any desired functions. Such features may be implemented within the LED controller, a luminaire controller or combinations thereof. Furthermore, all such features may be combined into such single electronic structure, may be separated as needed between functional lines or may be integrated in cooperative fashion. As such, a single controller, multiple controllers or combination of one or more controllers and electrical circuit implementation may be utilized to effectuate the various functions set forth herein. For example, an LED controller may work in combination with driver circuits for individual LEDs or banks of LEDs. Such drivers may include aspects of a controller feature set, may power or modulate the LEDs at variable levels or may be provided merely to set color temperature or other intensity characteristics.

Figure 14:
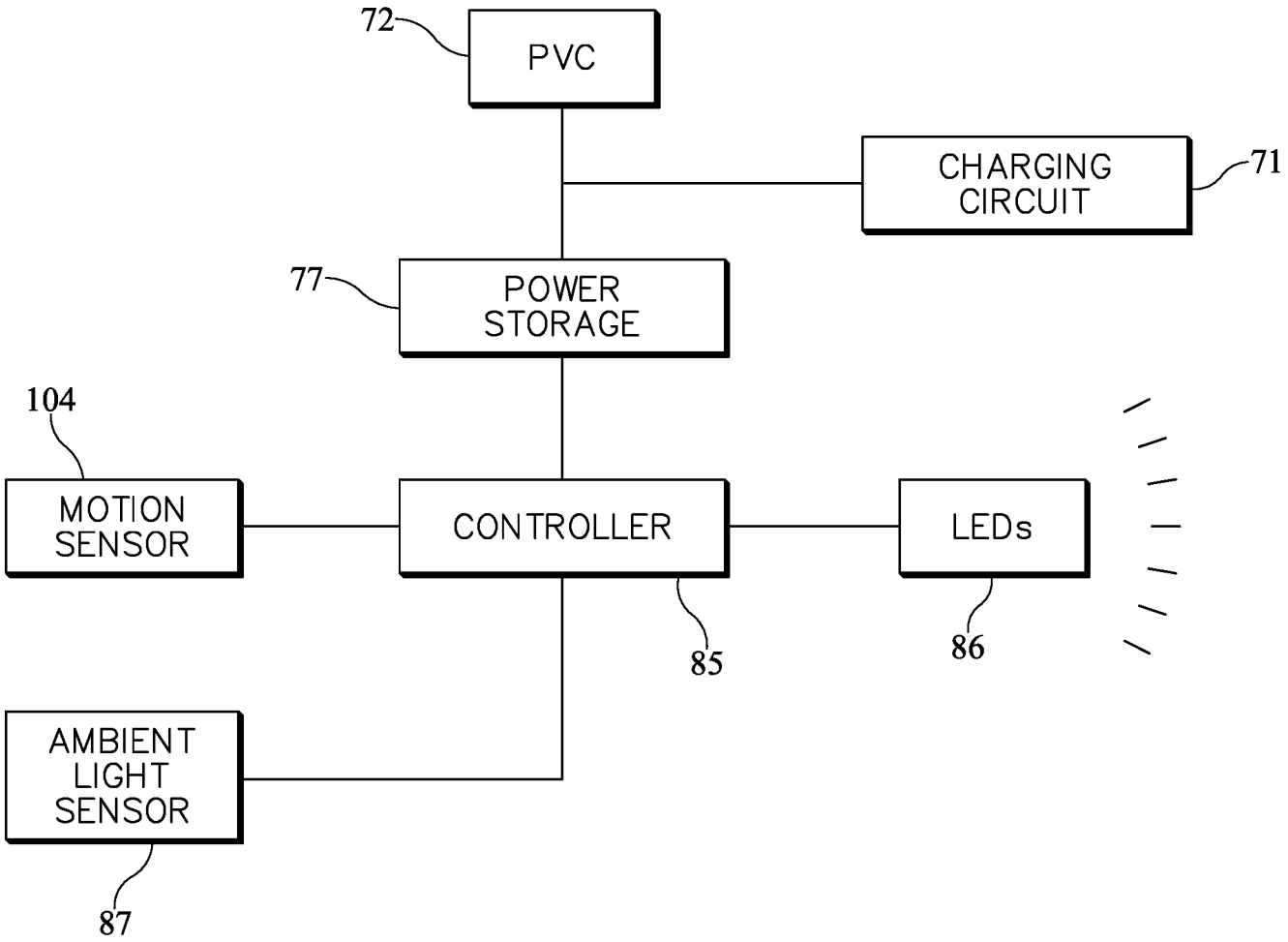
FIG. 14 details a component diagram for the security light set forth herein.

The controller 85, as shown in FIG. 14, may also be incorporated within the luminaire housing 112 or remotely. For example, an illumination controller may be placed locally within the luminaire housing to directly control the light output of the security light 100 and LEDs or other light sources. Alternatively, the controller may be positioned remotely from the luminaire housing 112 to make the luminaire housing much more compact and work jointly with drivers. For example, in some implementations, an illumination controller 85 may be placed at the remote charging station with the other required electronics. For example, the illumination controller 85 may include an LED controller which is integrated within the interior electrical cabinet 73 of the base 74 of the remote charging station 70, as shown in FIG. 12. Further, a charging circuit 71 may be provided in the base of the charging station 70 to controlling the charging of the rechargeable batteries 77. Providing such power supply, charging electronics and illumination controllers in a remote location, such as in the base of the charging station 70, the luminaire housing footprint can be kept small. Such electrical components may be connected to the luminaire housing and other components by an electrical connecting line 79.

Various components of the system may include the luminaire controller 85, LEDs or other illumination devices 86, sensors such as a motion sensor 104 or ambient light sensor 87, power storage 77, photo-voltaic cells 72, various electronics such as a charging circuit 71. The controller may have access to associated memory internally or connected thereto to allow storage of settings, program execution code or other instructions for implementation of the cited features. These components may be integrated into a singular housing or in separated housings.

For example, in some implementations, various selected electrical components may be integrated within the luminaire housing or in the lamp head 101. For example, the LED drivers or controllers may be incorporated within the lamp head structure, within the luminaire housing 112 or interspersed between all three housing areas, the charging base, the luminaire housing and the lamp head.

Figure 15A:
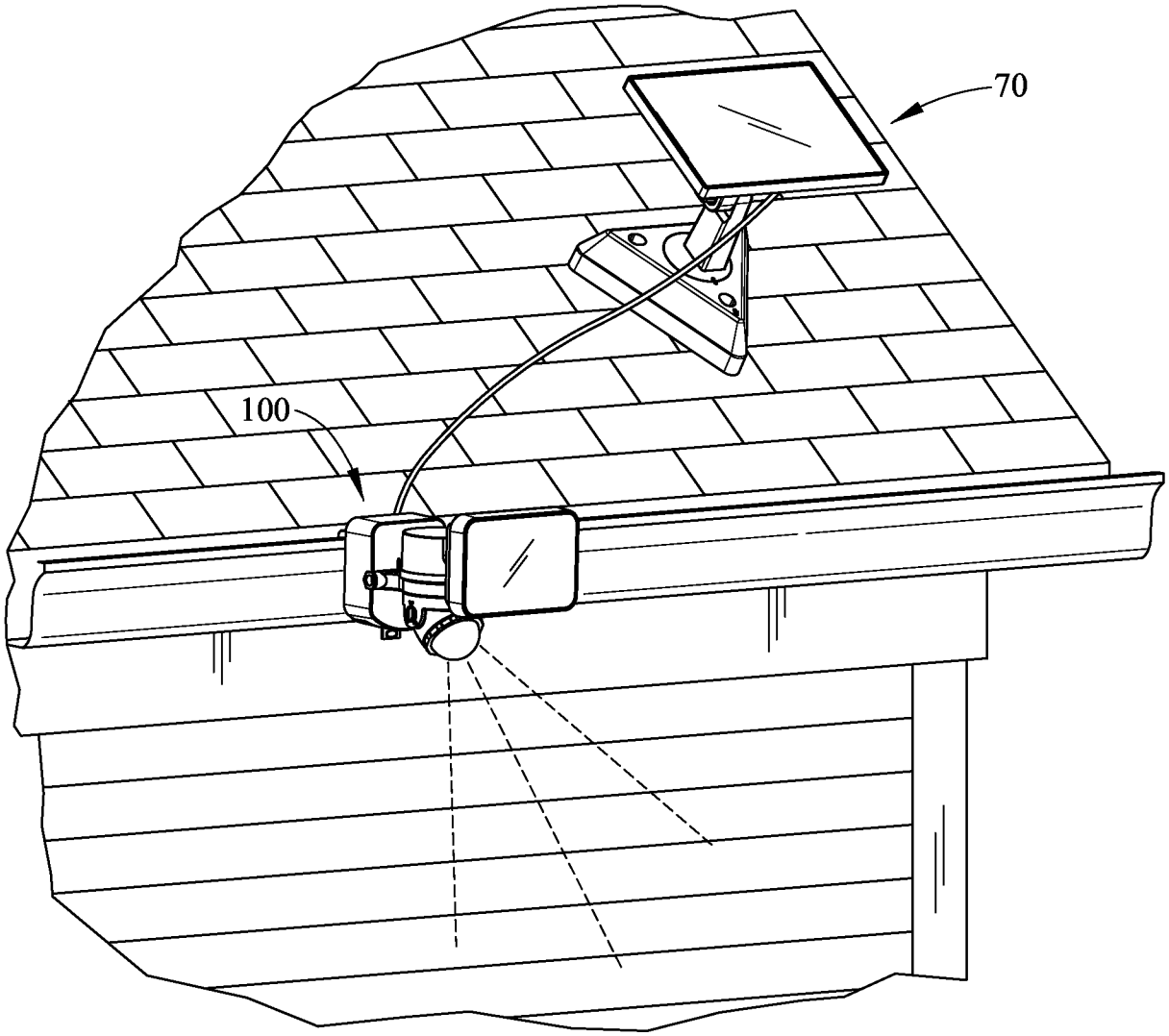
FIGS. 15A-15D describe multiple installation configurations for the security light described herein.
Figure 15B:
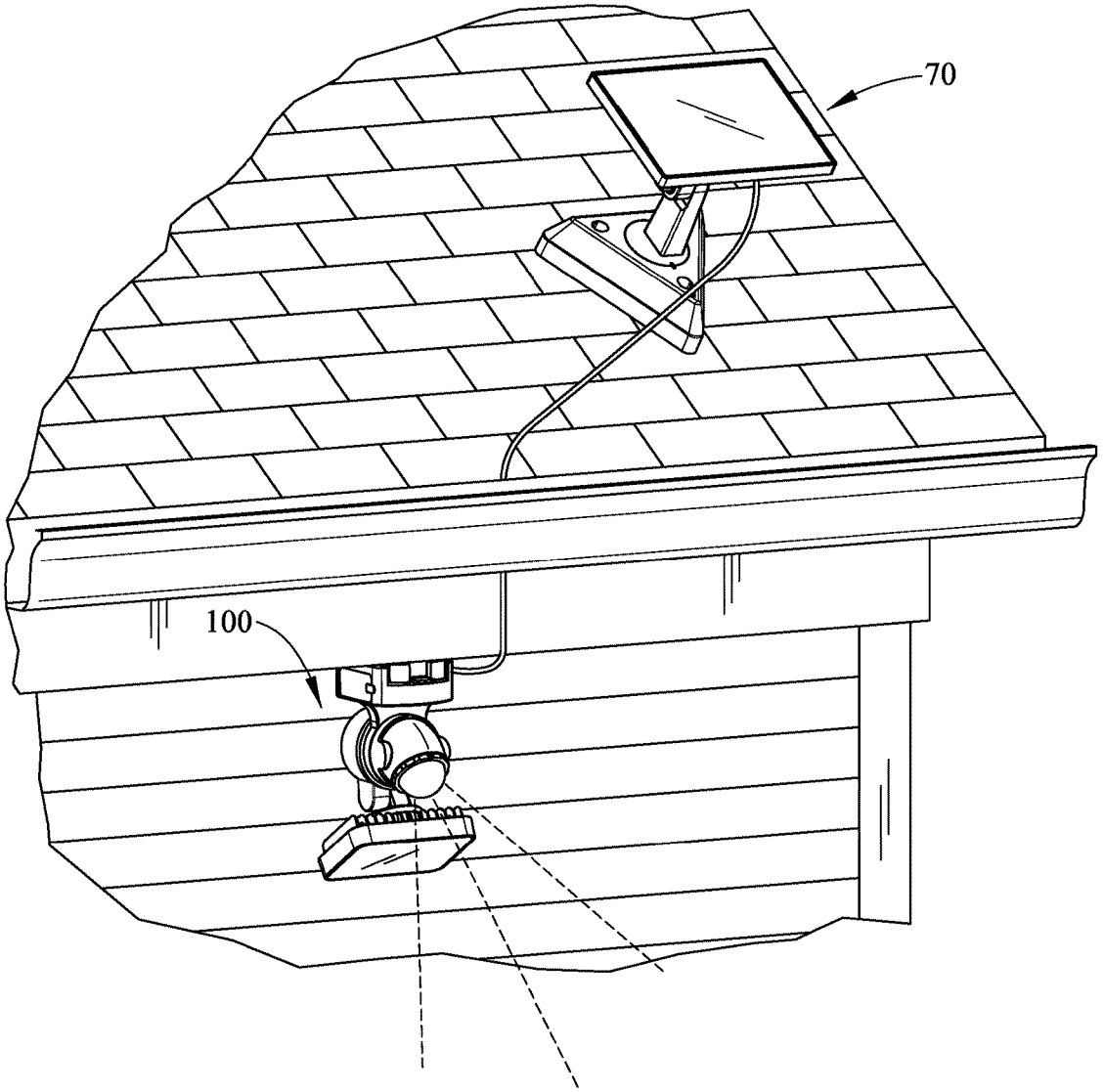
Figure 15C:
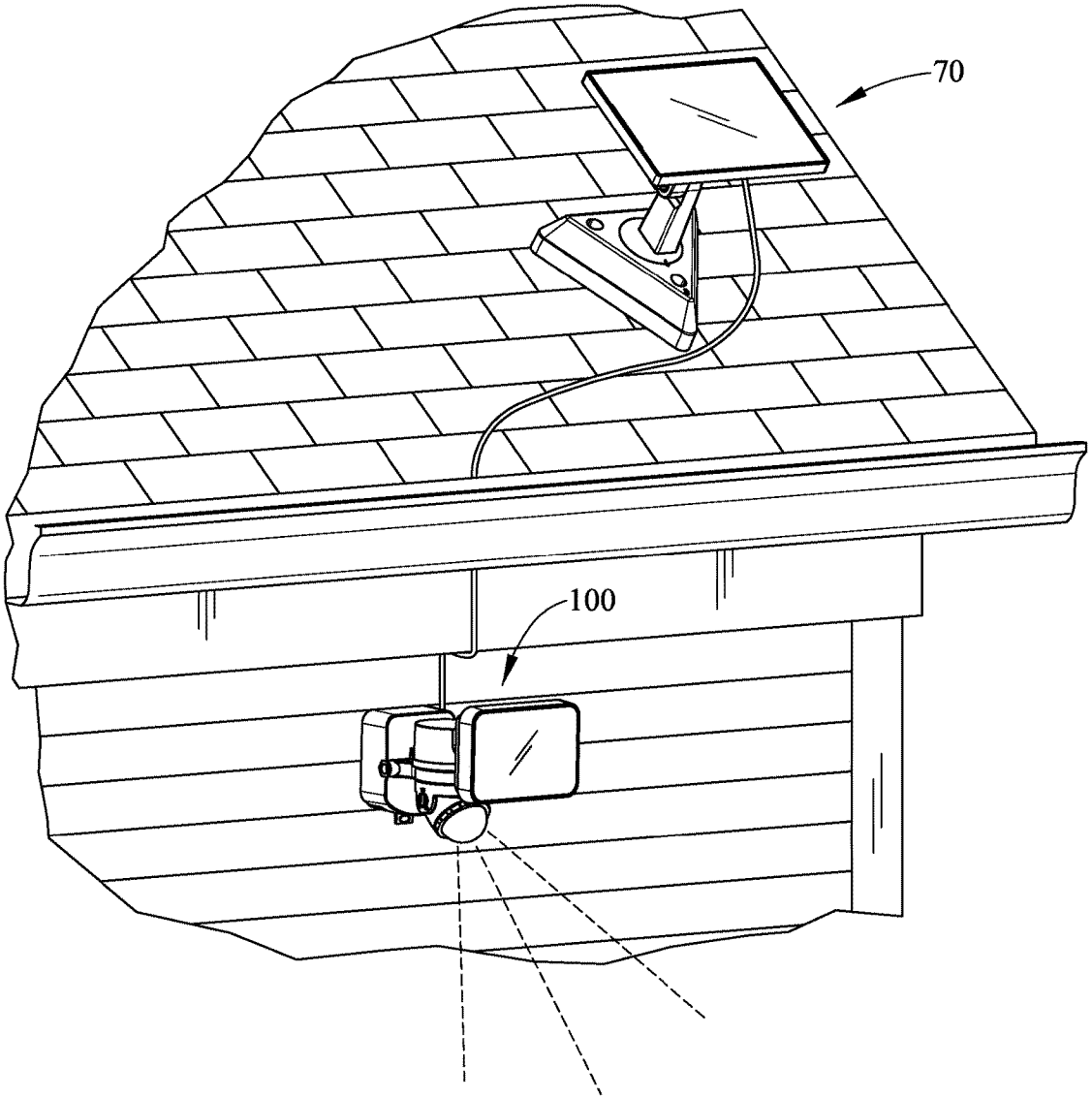
Figure 15D:
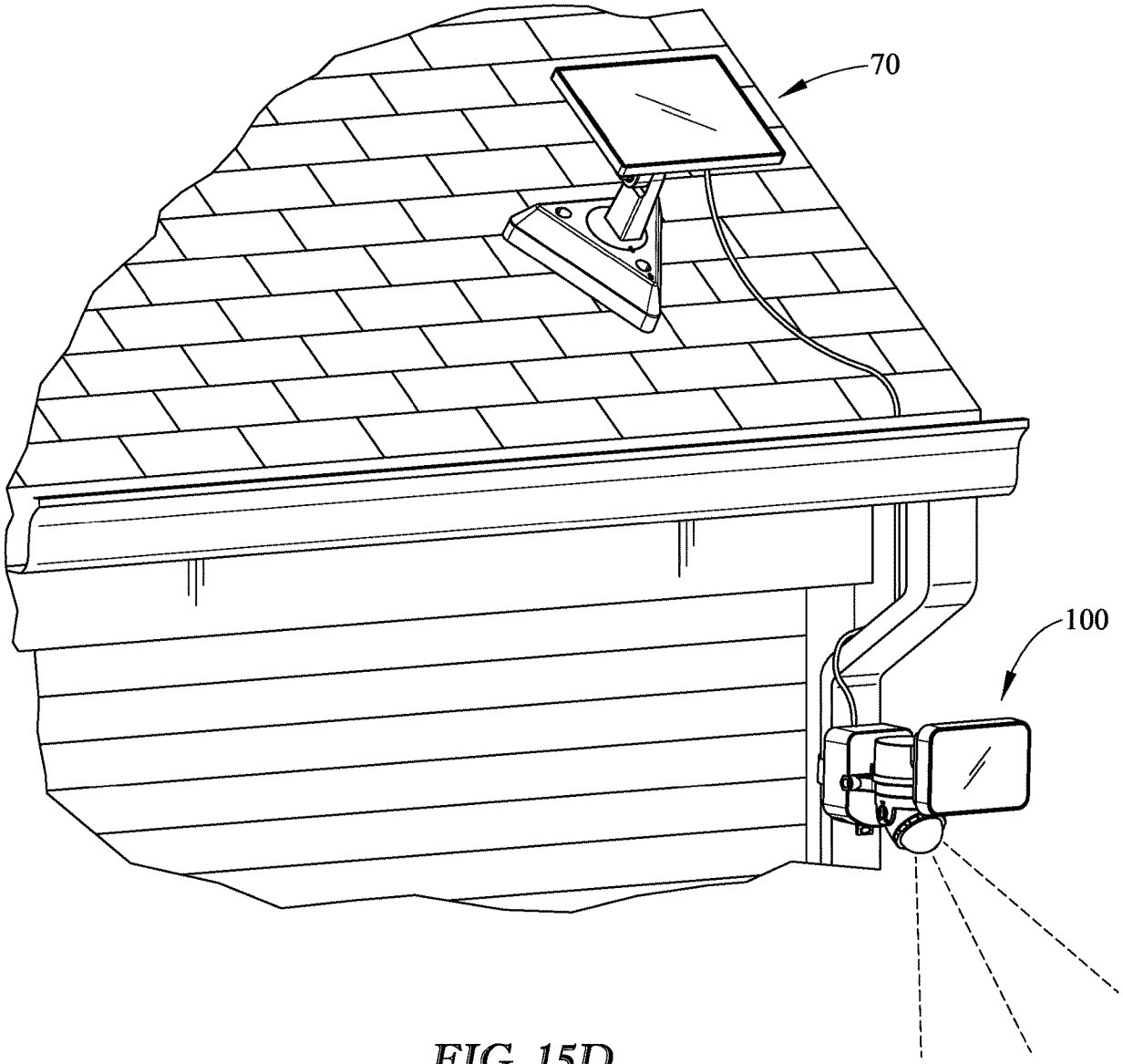

Mounting of the security light may be implemented under various scenarios. For example, utilization of the mounting bracket 30 may alternatively allow the security light 100 to be installed as depicted in FIGS. 15A-15D. By separation of the various electrical components between the charging station 70 and the luminaire 100, the luminaire housing footprint may be reduced to allow installation on a gutter (FIG. 15A), under an eave (FIG. 15B), directly to a wall (FIG. 15C) or to a pole or other vertically extending structure such as a gutter downspout (FIG. 15D). In providing a charging station 70 and associated charging circuit and control electronics, no line voltage is necessary thereby increase the variable installation locations for the luminaire and removing the need for installation close to house electrical lines.

Figure 5:
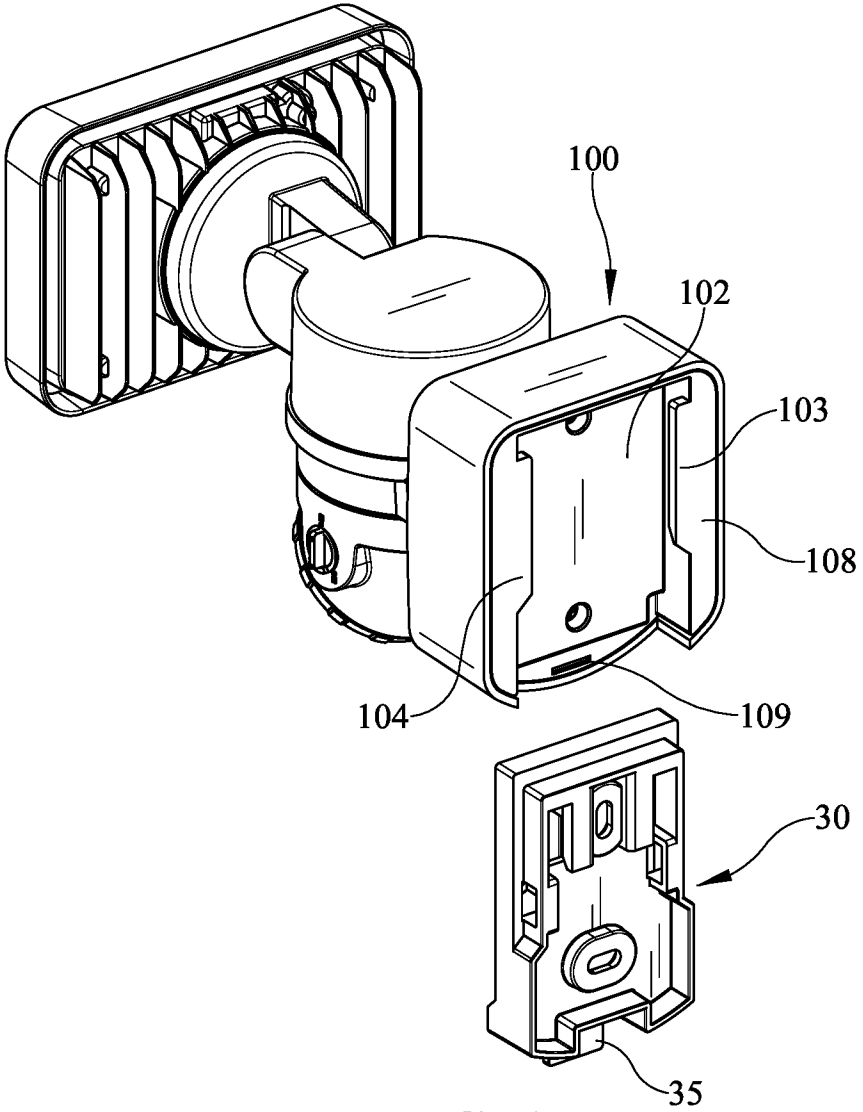
FIG. 5 illustrates one implementation of the security light mounting surface and mounting bracket described herein.

In an effort to allow the security light 100 to be mounted in multiple configurations, the housing mount 108 may include a mounting recess 102 which has opposing retention flanges 103, 104, as depicted in FIG. 5. The mounting recess may slidably receive a universal bracket 30 as depicted in the figures. For example, a universal mounting bracket 30 may be slidably received within the mounting recess and may be removably retained therein by a locking tab which may include a recess or other channel for snapping into place an associated bump or other projection of the mounting recess. In implementations, the recess may slidably receive the mounting bracket 30 by sliding the mounting bracket upward through the bottom recess opening wherein the bracket 30 is held in place by the opposing retention flanges 103, 104 of the housing mount 108 *n* combination with the locking tab. The bracket 30 may include an annular sliding flange, as is shown in FIGS. 5-10, which at least partially extends around the periphery of the mounting bracket 30.

As the bracket slides upward into the mounting recess 102, the sliding flange 33 is received within the recess 102 and retained by the retention flanges 103, 104 and is locked into position by the tab 35 and the channel recess 34 snapping over the projection 109 on the surface of the housing mount. Other implementations may be utilized to lock the bracket 30 into position on the rear of the housing mount 108 of the luminaire. For example, universal mounting bracket 30 may be surface mounted and lock into place by at least one removable screw or wing nut. Universal mounting bracket may be hinged and swing into position flush on the rear surface of the housing mount 108 and locked into place by biasing tabs which releasably hold an edge of the bracket in position. Other alternative structures may similarly be incorporated for affixing the bracket to the rear mounting surface of the luminaire, particularly as it may be necessary to mount and/or affix the bracket 30 in position and then attach the luminaire to the positioned bracket 30.

Figure 6:
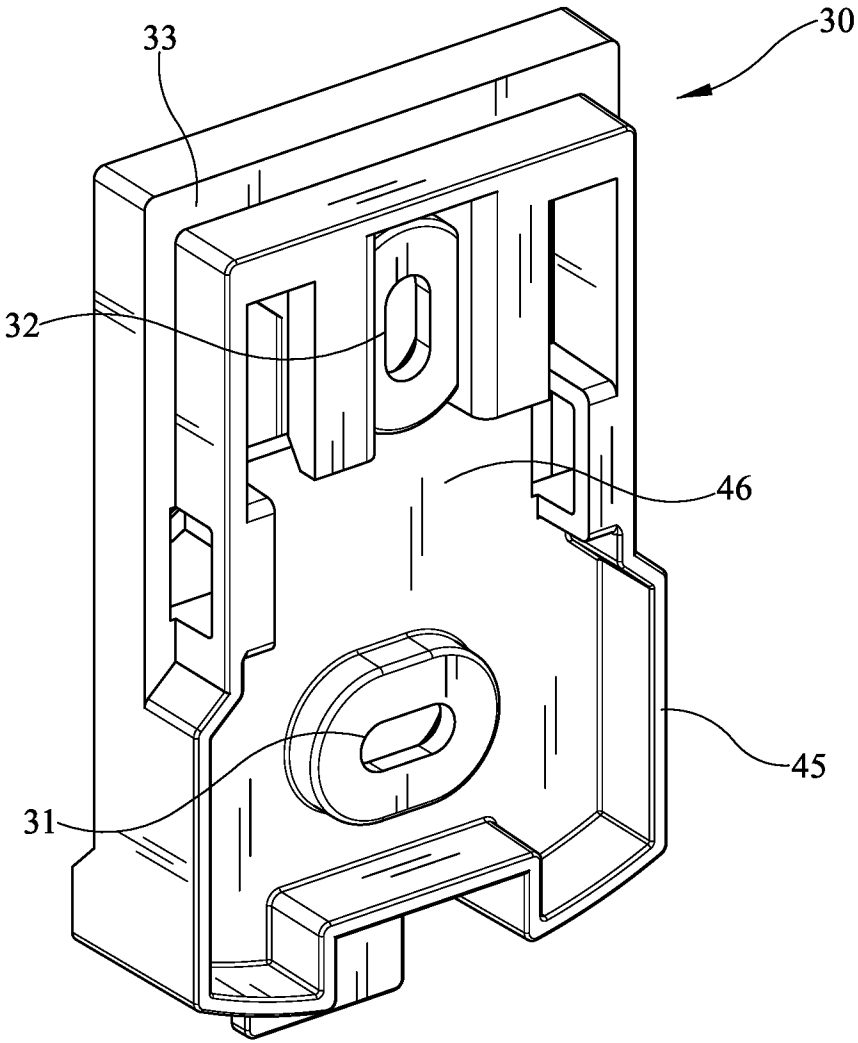
FIG. 6 illustrates a perspective view of the universal mounting bracket shown in FIG. 5.

For example, in some implementations, it may be necessary to affix the bracket 30 in an eave mount position wherein screws are placed through apertures 31 and 32, depicted in FIG. 6, Once the bracket is affixed to the underside surface of the structure, the luminaire housing may be easily affixed thereto by sliding the bracket 30 into the mounting recess 102 and locking the bracket 30 into place by utilizing the biased locking tab 35 and allowing the locking tab 35 to snap over a projection and lock such projection into a channel, aperture or other receiving structure 34.

In various implementations, the mounting bracket 30 may have a sliding flange 33 which extends at least partially around the periphery of the bracket. The sliding flange 33 may be formed by creating an inset bracket peripheral wall 45 which forms the recess area 46. The inset bracket peripheral wall 45 creates the sliding flange surfaces 39*a*, 39*b* shown in FIG. 9, which interact and are captured by the opposing retention flanges 103, 104. The raised peripheral wall 45 defines in interior recess area of the bracket 30 within which multiple mounting structures may be positioned. For example, mounting structures such as first and second mount aperture 31 32 may be formed within the recess area to allow screws or other attachment structures to affix the mounting bracket to a surface. Once affixed to the structure, the luminaire housing may be positioned and attached to the bracket by sliding the bracket 30 into the mounting recess of the luminaire housing.

Figure 7:
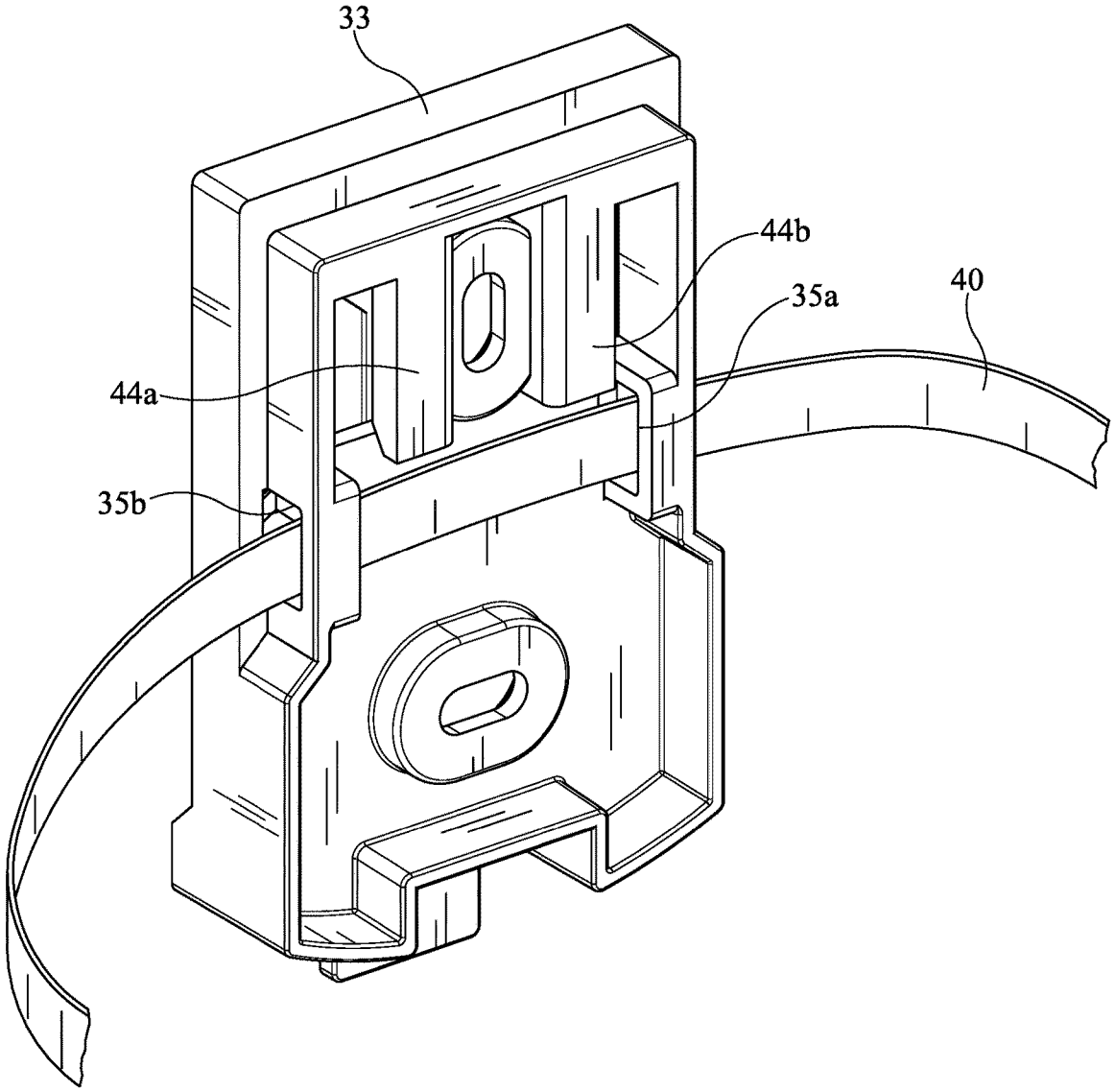
FIG. 7 illustrates a close up of the bracket in FIG. 6.
Figure 8:
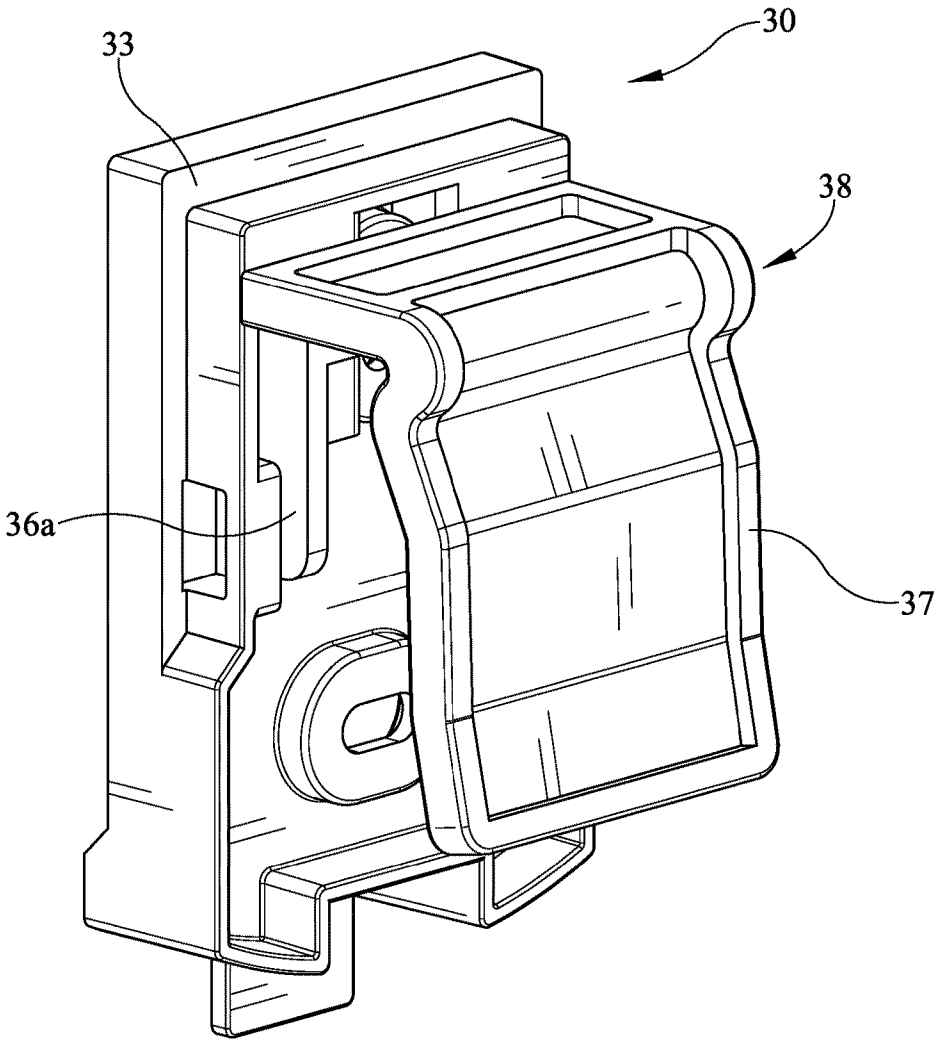
FIG. 8 illustrates a perspective view of the mounting bracket and gutter clip described herein in an assembled configuration.
Figure 9:
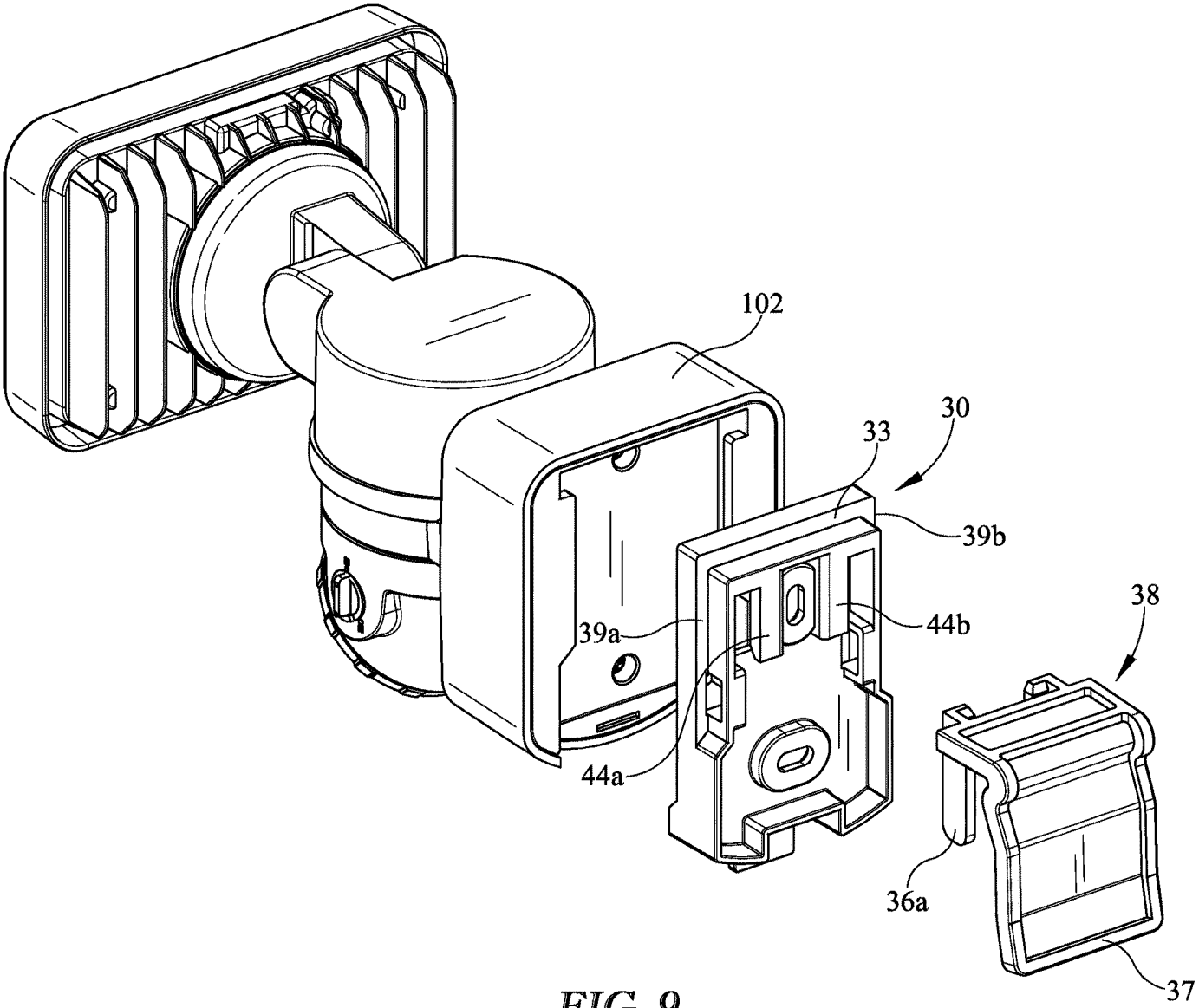
FIGS. 9 and 10 illustrate the security light mounting surface, mounting bracket and gutter clip.
Figure 10:
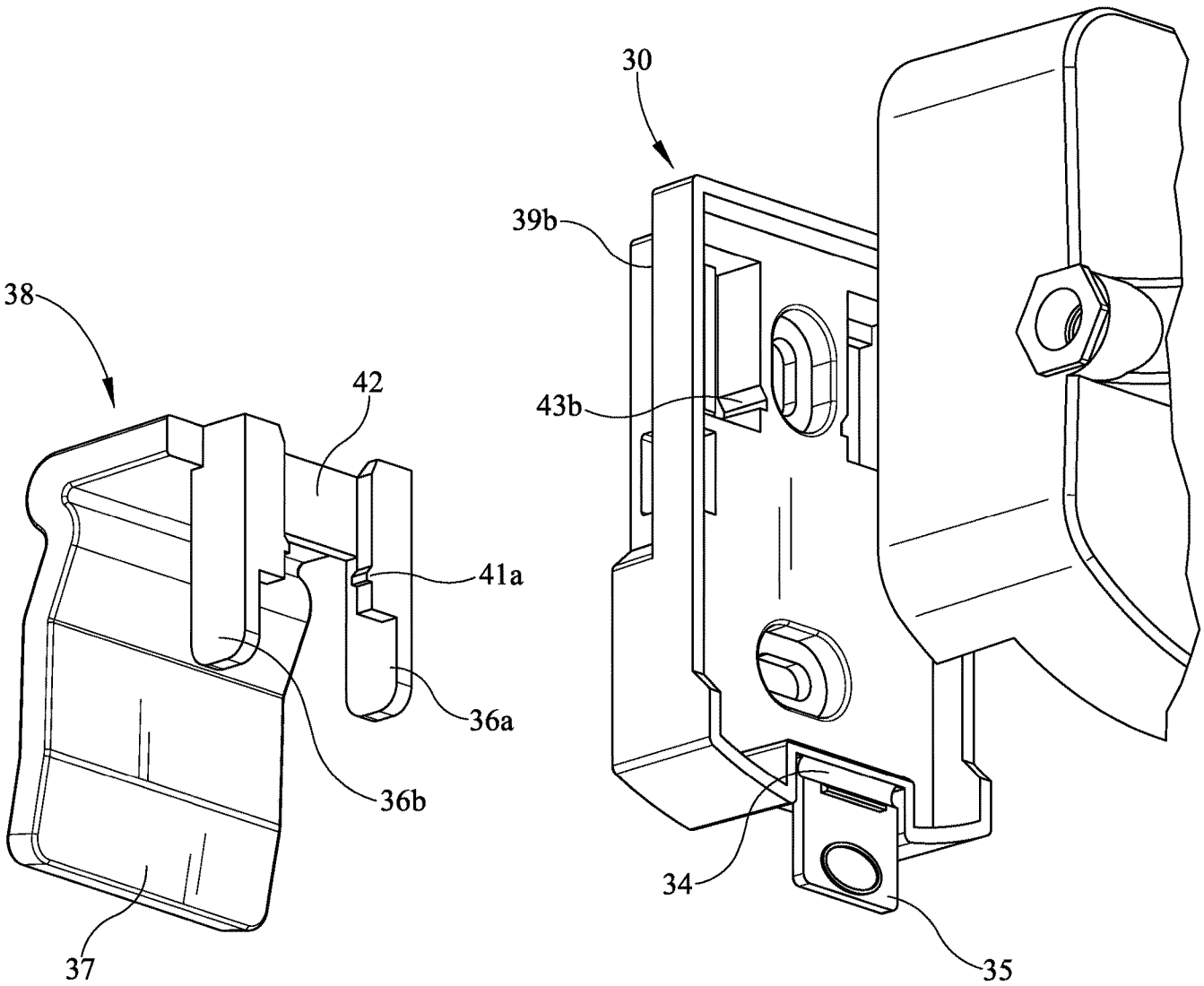

Alternatively, as is shown in FIG. 7, first and second strap apertures 35*a*, 35*b*, may be formed in the wall to allow a mounting strap 40 to extend through the strap apertures and wrap around a pole or other vertically extending structure. For in some implementations, the luminaire may be mounted to a pole, gutter downspout or other vertically extending structure. In such implementation, the mounting bracket 30 may include a mounting strap may be provided to extend through the strap apertures 35*a*, 35*b* and around the vertically extending structure. The strap may be tightened in such position and then the luminaire housing 112 may be affixed to the mounting bracket 30 held in place by the mounting strap 40.

In alternative implementations, the luminaire may be mounted to a gutter edge or other surface. A gutter clip 38 may be utilized and integrated with the mounting bracket 30 to affix the luminaire to the gutter. For example, the bracket 30 may receive a gutter clip 38 by sliding first and second gutter clip locking tongues 36*a*, 36*b* past the bracket retention tabs 44*a*, 44*b*. For example, in some implementations, the gutter clip locking tongues 36*a*, 36*b* may have a projection 41, extending inwardly toward the opposing locking tongue, which would then be removably received within a locking recess 43*b* formed on the bracket 30. Gutter clip cross member 42 may be provided to span between the bracket retention tabs 44*a*, 44*b* thereby affixing the gutter clip 38 in place in conjunction with the locking tongues 36*a*, 36*b* and the associated projection and locking recesses. Thereafter, the gutter clip may be removed from the mounting bracket 30 by squeezing the locking tongues towards one another thereby releasing the projections 41*a* from their associated recesses and the clip cross member 42 may be slid downwards from in between the retention tabs 44*a*, 44*b* and released therefrom.

Gutter clip 38 may include a depending flange 37 which is separated from the locking tongues so that the clip can slide over and around the edge of a gutter wall surface. The depending flange 37 of the gutter clip may extend and be angled slightly away from the locking tongues to allow for a clamping type action around the wide channel formed by the gutter. In other words, the mounting bracket 30 would rest on the exterior surface of the gutter while the depending flange depends into the interior of the gutter channel and would mold around the rolled top edge of the gutter. After installation of the gutter clip and mounting bracket combination, the luminaire housing may then be affixed to the bracket by the luminaire housing mount 108 such that the security light is suspended from the gutter by the gutter clip.

Figure 13:
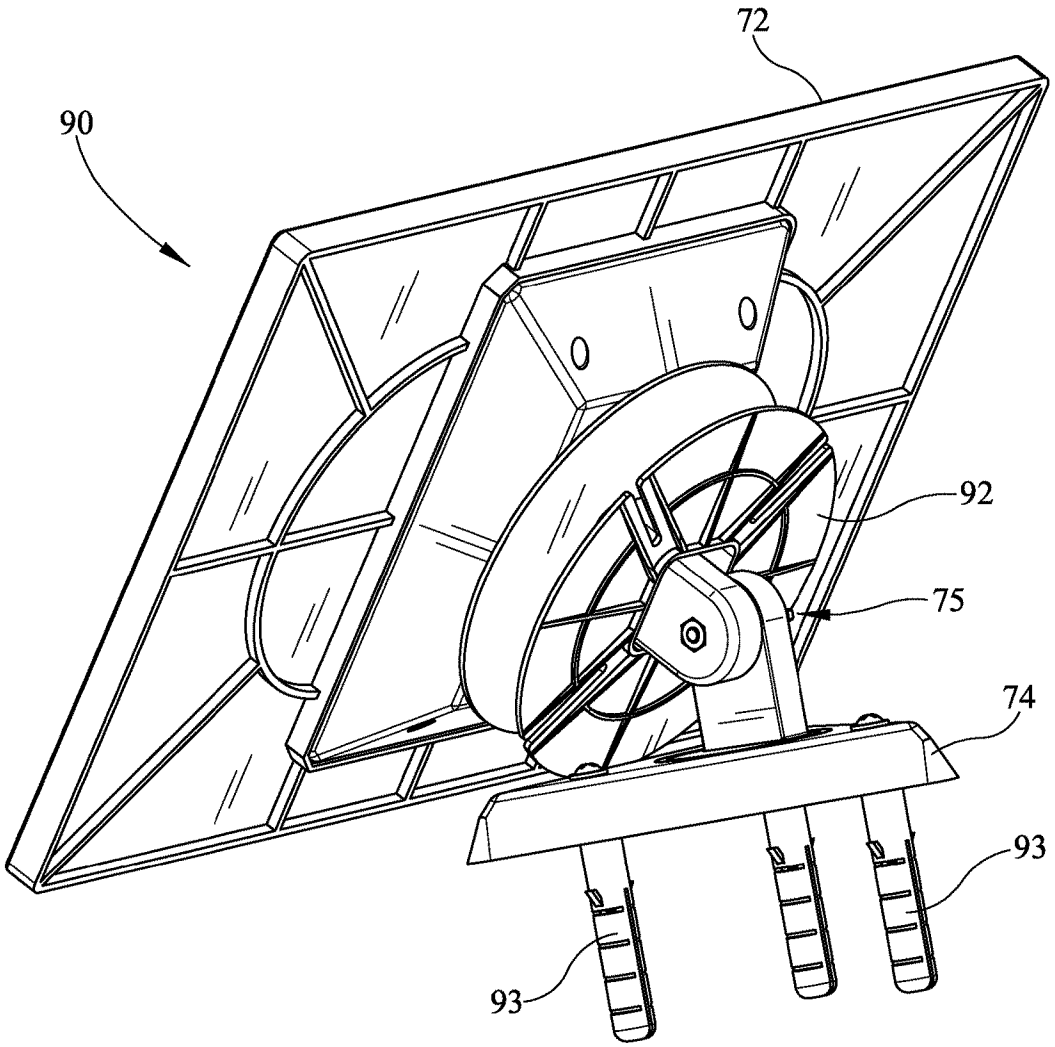
FIG. 13 discloses another embodiment of the solar charging station described herein.

Integrated with or positioned remotely from the luminaire housing 112 of the security light 100 may be a solar charging station including the photo-voltaic solar cells 72. The solar charging station 70, 90 may be hingedly affixed to a base 74 by hinge 75 so that the PVC's may be appropriately directed towards the sun during the day and allow for maximization of the charging cycle for the rechargeable batteries or other power storage 77. As shown in FIGS. 11 and 12, the PVC solar cells 72 extend away from the base, which may be mounted on a roof or other structure, and are adjustable to relative to the base. Mounting fasteners 93, shown in FIG. 13, may be provided for affixation of the base to an appropriate structure. Similarly, base 74 may include attachments for affixing bracket 30 to the base for modifying the available attachment structures which the base and charging station 70,90 may be affixed to. For example, the bracket 30 may be directly affixed to the base 74 and allow the base to be affixed to the various structures identified herein or may allow attachment to the gutter clip 38 so as to similarly affixed the base to a gutter as described herein. Base 74 would include appropriate attachment mechanisms to affix the bracket 30 directly to the base to provide a wide variety of attachment structures and configurations of the base and associated hardware.

In some implementations, the solar charging station may have a plurality of photo-voltaic cells which are mounted on a frame and which are adjustable relative to the mounting structure. For example, the base may be connected to a swivel mounting 92 in addition to or alternatively with the hinge 75 to maximize cell placement relative to the sun. Within the base 74 may also be positioned an electrical cabinet 73 to contain at least the charging circuit which is connected to the PVC and the rechargeable batteries. The various electronics positioned within the cabinet 73 may be connected to the luminaire housing by the associated electrical line 79 shown in FIG. 3. In various implementations, the solar charging station may be directly adjacent with the luminaire housing 112, may be affixed thereto or may be positioned remotely therefrom. For example, in some embodiments, the charging station 70, 90 may be a remote charging station positioned on a roof while the luminaire housing 112 and associated lamp heads and mounting structures may be positioned underneath of the eave where the sun would not regularly be available for charging of the batteries. Thus, in some installation configurations, the security light 100 may be positioned in a location where regular sunlight is prevented from being available thus allowing a remote installation for the charging station 70, such as on the roof, to be more efficient in charging the power supply.

The electrical cabinet 73 may in addition include many of the electrical components of the security light such as the luminaire controller 85, power storage 77, LED controller, charging circuit and other electronics. For example, in some implementations, various electronics such as communication circuits to allow remote control of the security light, may be implemented. In such examples, a Wi-Fi, blue tooth, ZigBee or other short range communication protocols may be implemented with supporting electronics. These communication electronics may be powered by the power storage devices 77, such as rechargeable batteries, secondary power storage device or alternative electrical supply. Beneficially, in some remote installation, the solar charging station and the associated and/or incorporated electronics may allow a smaller luminaire housing to be readily installed in a smaller and/or tighter footprint without the need to provide line voltage to the location of installation. In some implementations, the associated controller 85 may be positioned remote to the luminaire housing 112 along with other electronics for operating the LEDs or other alternative light sources. For example, in some embodiments, associated memory will be in electronic communication with the luminaire controller 85 allowing the controller to execute program instructions in reading the various sensors and controlling the illumination levels of the LEDs. For example multiple sensors may provide input to the luminaire controller allowing the controller to modify light output. These sensors may include an ambient light sensor 87, motion sensor 104, battery charging level from the charging circuit 71, ambient temperature levels and other inputs to properly maximize the output of the LEDs while also maintaining appropriate charge in the battery. For example, variable control of the LEDs and the security light and associated electrical components and/or program instructions may include multiple level lighting at dusk and motion sense, reduction in the driven frequency of the LEDs depending on the charge level of the power source, utilization of reduced segments of the LEDs or other features.

In alternative implementations, various electronic components may be split between the solar charging station and the luminaire housing, secondary housings singularly combined. For example, the LED drivers may be positioned within the lamp head 101 while other components may be included within the luminaire housing and/or in the base 74 or other areas of the charging station 70.

In embodiments, the security light may incorporate additional sensing devices such as optical sensors to determine ambient light levels. For example, the luminaire may incorporate a photocell, allowing input to the luminaire controller allowing the security light to come on at dusk. Such optical sensors may also be combined with other location finding techniques allowing the security light 100 to determine location and time zone and correlating location with predetermined or calculated sunset and sunrise times. Alternatively, the lighting controller may have associated electronics and memory to allow programming of customer/installed desired on/off times after dusk, illumination ON times after sensing motion, full dusk to dawn illumination, partial or lower light intensity dusk to dawn illumination for the entire period or for user defined periods, modification of intensity levels, or other customer desirable modifications. Further, the controller may further be configured to sense a hard 'reset' or active 'ON' by manual switching OFF then ON of the power at the switch by the user. In some implementations, cameras and/or voice control may be used to control the characteristics of the light panels/security light. All of such features may be incorporated into controller programming where a microprocessor executes instructions stored in an associated memory, or in alternative or combined configurations, some or all features may be implemented with associated circuit controls incorporated into the controller.

In some implementations, it may be desirable to allow the user to reprogram the delay times, sensitivity of the PIR and or motion sensors, light intensity levels and color, color temperature, sensitivity and or triggering of the optical sensors for dusk and dawn determination, as well as ON times and lower illumination times and or levels. Such reprogramming may be implemented with switches at the security light, or may be readily implemented with associated reprogramming by a user through a mobile programming device, such as a phone or dedicated remote control. Such reprogramming capability may require implementation of communication channels for both transmission and receiving commands from a remote source. Corresponding applications may be implemented for modification of such features on a user mobile device. In some embodiments, a wireless connection may be established according to various wireless standards such as Wi-Fi, Bluetooth, or ZigBee to vary the light output of the first and/or second light panels. Other types of wireless links may be used.

For example, a user may select and/or modify ON time after the motion sensor detects motion while also selecting the illumination intensity, such as dimming the illumination levels slowly during change in state. In alternative embodiments, the user may select and/or modify the specific colors utilized by the light panels, if supported, and may include user modification of the color temperature. Such modifications may be implemented either for each light panel or individually for a single light panel.

In some embodiments, user specified alternative modifications may further include flashing or blinking lights of each or both light panels under predefined conditions. For example, in some implementations, one or more light panels may be programmed to flash intermittently to indicate an alert or warning condition, such as the detected interruption of power. Alternatively, a flashing alert or warning condition may be implemented by programming or user adjustment of controls by one or more light panels upon detection of motion while concurrently increasing illumination intensity of one or more light panels.

Various implementations for drivers of the LEDs may be utilized including microprocessors, the linear AC drivers are constant current regulators. In other embodiments, the linear AC drivers are ASICs. Other drivers may be used. The LEDs may be provided as arrays, individual emitters, any of which may be directly addressable and hence drivable by control and/or micro-processors and included programming stored on available and accessible memory. Such may include in implementations, current regulators, voltage regulators, micro-controllers and other known circuitry to maintain illumination levels and other characteristics of the LEDs.

In implementations, the security light may utilized the rechargeable batteries as a battery back-up such that the batteries, when at a predetermined and specified voltage or condition, provide power to the illumination sources. The battery backup may also be operably connected to a separate power supply and allow the security light to switch between rechargeable battery power source and an alternative source such as line voltage.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A variably mountable security light with remote solar charging panels and a multiple support mounting bracket, comprising:

a motion security light having a lamp head with a light emitting surface, the lamp head hingedly connected to a luminaire housing, the luminaire housing also having a motion sensor;

a plurality of light sources behind the light emitting surface on the lamp head, the plurality of light sources in electrical communication with a light controller;

the luminaire housing having a housing mount, the housing mount including a mounting recess and a first and a second retention flange respectively on opposing sides of the mounting recess;

a solar charging base having a photo-voltaic cell panel hingedly connected to the charging base, the charging base including an interior electrical cabinet containing at least one energy storage unit, the solar charging base and the at least one energy storage unit in electrical connectivity with the plurality of light sources in the luminaire housing;

wherein the solar charging base is remotely positioned from the luminaire housing and electrically connected to the luminaire housing through an electrical connector line;

a universal bracket removably retained within the mounting recess of the luminaire housing;

the universal bracket including a first and a second mounting aperture, a first and a second strap aperture and gutter clip removably attachable to the universal bracket.

2. The security light of claim 1 wherein the luminaire housing is fixedly connected to the housing mount.

3. The security light of claim 1 wherein the housing mount is integral with the luminaire housing.

4. The security light of claim 1 wherein the gutter clip has a depending flange opposite to first and second depending gutter clip locking tongues.

5. The security light of claim 1 wherein the universal bracket has a sliding flange extending around at least a portion of a periphery of the universal bracket, wherein the sliding flange extends around an upper edge and partially around first and second opposing side edges.

6. The security light of claim 5 wherein the universal bracket has a recessed area defined by a bracket peripheral wall.

7. The security light of claim 6 wherein the bracket peripheral wall has a first and a second bracket retention tab depending from the peripheral wall into the recessed area.

8. The security light of claim 6 wherein the first and the second strap aperture are formed in opposing relationship on the universal bracket peripheral wall.

9. The security light of claim 6 wherein the bracket peripheral wall is inset on the universal bracket forming the sliding flange.

10. The security light of claim 4 further comprising:

a cross member extending across the first and second depending locking tongues of the gutter clip;

an inwardly directed projection formed on at least one of the first or second gutter clip locking tongue which fits into an associated locking recess formed on the universal bracket.

11. The security light of claim 10 wherein each of the first and the second gutter clip locking tongues have an inwardly directed projection mating into an associated locking recess formed in the universal bracket.

12. The security light of claim 1 wherein the solar charging base electrical cabinet includes a charging circuit in connectivity with the photo-voltaic cell panel and with the at least one energy storage unit.

13. The security light of claim 1 wherein the solar charging base includes the light controller within the electrical cabinet, the light controller in electrical connectivity with the plurality of light sources and modulating the light sources with electrical power from the at least one energy storage unit.

14. The security light of claim 1 wherein the solar charging base has a plurality of anchors to secure the solar charging base to a structure.

15. A variably mountable security light with remote solar charging panels and a multiple support mounting bracket, comprising:

a lamp head hinged to a luminaire housing, the lamp head including a plurality of light sources in thermal contact with a heat sink, the plurality of light sources in electrical communication with a light controller;

the luminaire housing having a luminaire housing mount, the housing mount having a housing mounting recess and opposing first and second retention flanges on a first and second side of the housing mounting recess, the housing mounting recess and first and second retention flanges slidably receiving a mounting bracket;

the mounting bracket having a sliding flange extending along at least a portion of the peripheral edge of the bracket, the sliding flange formed by an inset bracket peripheral wall, the bracket peripheral wall inset on at least a portion of an outer edge of the periphery of the bracket, the inset bracket peripheral wall forming the sliding flange;

the mounting bracket having a first and a second mounting aperture forming a recess area surrounded by the bracket peripheral wall;

the bracket peripheral wall having opposed first and second strap apertures;

the bracket having at least one bracket retention tab operable to slidably receive a gutter clip, the gutter clip having a depending flange opposing the at least one bracket retention tab creating a space there between, the at least one bracket retention tab also having a locking recess which receives a projection tab on the gutter clip to lock the gutter clip into place on the mounting bracket;

a solar charging station having a photo-voltaic cell hinged to a charging station base, the charging station base including a charging circuit and the light controller, the charging station electrically connected to the luminaire housing by an electrical connecting line and operable to power the plurality of light sources and control the plurality of light sources in the lamp head.

16. The variably mountable security light of claim 15 wherein the mounting bracket has a first and a second bracket retention tab to slidably receive the gutter clip, each of the first and the second bracket retention tab having a locking recess to receive a projection extending from respective first and second gutter clip locking tongues on the gutter clip.

17. The variably mountable security light of claim 16 wherein the gutter clip depending flange opposes the first and second locking tongues and is angled away from the locking tongues.

18. The variably mountable security light of claim 15 wherein the mounting bracket has a depending locking tab having a channel, the depending locking tab channel of the mounting bracket receiving a projection extending outward from the housing mounting recess to lock the mounting bracket in place after being slidably received in the mounting recess.

19. The variably mountable security light of claim 18 wherein the sliding flange includes a first sliding flange surface and a second sliding flange surface, the first and second retention flanges of the housing mount respectively sliding over the first and the second sliding flange surfaces of the mounting bracket.

20. A variably mountable security light with remote solar charging panels and a multiple support mounting bracket, comprising:

a motion security light having a lamp head with an LED emitting surface, the lamp head hingedly connected to a luminaire housing;

a plurality of LEDs behind the LED emitting surface on the lamp head, the plurality of LEDs in electrical communication with an LED controller;

the luminaire housing having a housing mount, the housing mount including a mounting recess and a first and a second retention flange respectively on opposing sides of the mounting recess;

a solar charging base having a photo-voltaic cell panel hingedly connected to the charging base, the charging base including an interior electrical cabinet containing at least one rechargeable battery, the solar charging base and the at least one rechargeable battery in electrical connectivity with the plurality of LEDs in the luminaire housing;

wherein the solar charging base is remotely positioned from the luminaire housing and electrically connected to the at least one rechargeable battery through an electrical connector line;

a universal bracket removably retained within the mounting recess of the luminaire housing;

the universal bracket including a first and a second mounting aperture, and a first and a second strap aperture.

21. A variably mountable security light with remote solar charging panels and a multiple support mounting bracket, comprising:

a motion security light having a lamp head with an LED emitting surface, the lamp head hingedly connected to a luminaire housing;

a plurality of LEDs behind the LED emitting surface on the lamp head, the plurality of LEDs in electrical communication with an LED controller;

the luminaire housing having a housing mount, the housing mount including a mounting recess and a first and a second retention flange respectively on opposing sides of the mounting recess;

a solar charging base having a photo-voltaic cell panel hingedly connected to the charging base, the charging base including an interior electrical cabinet containing at least one energy storage unit, the solar charging base and the at least one energy storage unit in electrical connectivity with the plurality of LEDs in the luminaire housing;

wherein the solar charging base is remotely positioned from the luminaire housing and the luminaire housing is electrically connected to the at least one energy storage unit through an electrical connector line;

a universal bracket removably retained within the mounting recess of the luminaire housing.

* * * * *